United States Patent [19]

Tokuno

[11] 4,369,905

[45] Jan. 25, 1983

[54] METHOD AND APPARATUS FOR GUIDING A CORRUGATED FIBREBOARD WEB

[75] Inventor: Masateru Tokuno, Nishinomiya, Japan

[73] Assignee: Rengo Co., Ltd., Osaka, Japan

[21] Appl. No.: 213,154

[22] Filed: Dec. 4, 1980

[30] Foreign Application Priority Data

Dec. 5, 1979 [JP] Japan ..... 54-160189

[51] Int. Cl.[3] ..... B65H 25/26; B65H 25/32

[52] U.S. Cl. ..... 226/17; 226/45

[58] Field of Search ..... 226/16, 17, 18, 19, 226/20, 45, 196; 250/560, 571, 572; 242/76

[56] References Cited

U.S. PATENT DOCUMENTS

| | | | |
|---|---|---|---|
| 2,947,057 | 8/1960 | Meagher | 226/17 X |
| 3,147,898 | 9/1964 | Hyck | 226/17 |
| 3,152,941 | 10/1964 | Sherman | 226/45 X |
| 3,371,916 | 3/1968 | Jaeger | 226/17 |
| 3,414,954 | 12/1968 | Alexeff | 226/17 X |

*Primary Examiner*—Edward J. McCarthy

*Attorney, Agent, or Firm*—Wenderoth, Lind & Ponack

[57] ABSTRACT

A method and an apparatus for guiding a corrugated fibreboard web in which the edges of a running web are detected and followed by a pair of sensors and a pair of web guides are controlled to move according to the width of the web to positions at an equal distance from a certain reference line, e.g. the machine center.

10 Claims, 14 Drawing Figures

METHOD AND APPARATUS FOR GUIDING A CORRUGATED FIBREBOARD WEB

The present invention relates to method and apparatus for guiding a web and particularly to method and apparatus for guiding a single faced corrugated fibreboard on a corrugating machine so as to prevent it from running out of true.

In a corrugating machine for producing double faced corrugated fibreboards or double wall corrugated fibreboards, it is necessary to give a suitable degree of tension to the webs and corrugated fibreboards and to prevent them from running out of true, before they enter the preheater. If they were loose, this would result in poor contact with the heater drum and thus poor heat absorption, and poor application of glue by the glue roll to the crests of the corrugations or production of warped fibreboards. Also, if the single faced fibreboards were fed out of true, defective fibreboards would be produced because they would have edges not aligned with those of the linerboard. Further, feeding out of true would frequently cause machine troubles.

Conventional web guide systems for this purpose comprise a brake roller or similar guide means around which the running web passes and a pair of guide pieces mounted so as to be movable transversely along the guide means, said guide means being adpated to give a tension to the web by hard contact with the web and said guide pieces being adapted to guide the edges of the web running at a high speed so as to prevent it from running out of true. Such conventional web guide systems have a shortcoming that contact of the web with the guide means and/or with the guide pieces produce an abnormally high noise, thus worsening the work environment in the factory and necessitating the provision of some noise prevention means. Another shortcoming is that the web is liable to break because excessive tension is sometimes applied to the web. This tendency is marked particularly when the web used is relatively thin. A further problem is that since the guide pieces are controlled manually with a handle or semi-automatically with a pushbutton to bring the distance between them into accord with the width of the running web, their position cannot be readjusted quickly and accurately in response to an abrupt change of web width.

An object of the present invention is to provide method and apparatus for guiding a corrugated fibreboard web which obviate the above-mentioned shortcomings and which provide for instantaneous, accurate, automatic adjustment of the position of web guides for respective web edges according to the width of the running web to be guided.

Other objects and advantages of the present invention will become apparent from the following description taken with reference to the accompanying drawings in which.

Figure 1:
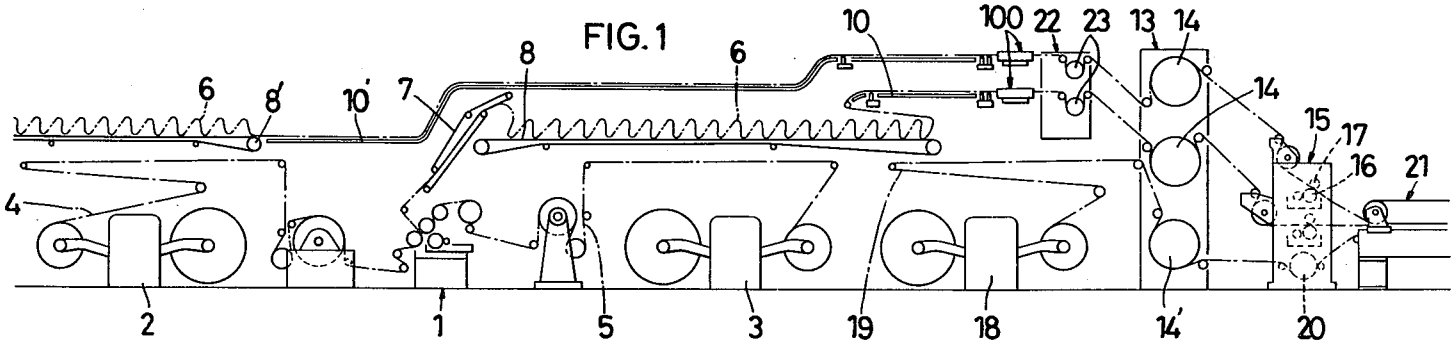
FIG. 1 is a schematic view of a corrugating machine in which the web guide system according to this invention is used.

Referring to FIG. 1, a single facer 1 is supplied from mill roll stands 2 and 3 with a linerboard 4 and a corrugating medium 5, respectively. The single facer corrugates the medium 5 and glues the linerboard 4 to the corrugated medium to produce a single faced corrugated fibreboard 6.

Ordinarily, two single facers 1 are provided under a bridge (not shown) and a single faced corrugated fibreboard 6 from each of these single facers is fed by a vertical conveyor 7 to low-speed belt conveyor 8 and 8' which serve as an accumulator and which in turn, feed the single faced fibreboard 6 to guide plate 10 and 10'.

The numeral 100 generally designates the web guide system according to the present invention. Downstream of the web guide system is provided a tension unit 22 where each fibreboard 6 is passed around a tension roll 23 to apply a suitable tension.

Each fibreboard is then wound around a heater drum 14 in a preheater 13, and then fed to a glueing machine 15 where it is passed between a glue roll 16 and a rider roll 17 to apply glue to the crests of the corrugations.

On the other hand, a linerboard 19 from a mill roll stand 18 is similarly preheated by a heater drum 14' in the preheater 13 and has its temperature adjusted by a heater drum 20 in the glueing machine 15.

The linerboard 19 thus preheated and the two single faced corrugated fibreboards 6 are fed into a double facer 21 which glues them together to produce a double wall corrugated fibreboard.

In a corrugating machine, a web is ordinarily guided to run so that its center is aligned with substantially the center line of the machine. Therefore, in the preferred embodiment, the web guide system is controlled to align each single faced corrugated fibre-board with the center line M of the corrugating machine.

Two single faced corrugated fibreboards 6 are controlled in the same manner, of course. Both edges of each fibreboard are guided in the same manner by means of the web guide system of this invention. Therefore, it will be described how to guide only one fibreboard and only one edge thereof.

The web guide system 100 according to the present invention will be described below with reference to FIGS. 2 and 3.

The web guide system includes a pair of web guides 101, a guide moving unit 110 for moving the web guides in a transverse direction, and a sensor means which detects the edge of the web, generates an electrical signal and actuates the guide moving unit 110 to move the web guides 101 for a distance proportional to the electrical signal.

As shown in FIGS. 4–7, the web guide 101 includes a plurality of rolls 102 and an endless belt 103 passing around the rolls. The inner side of the endless belt is straight and serves as a guide portion 104 which touches the edge of the running web 6 to guide it. The web guide 101 is mounted on a guide supporting plate 105 and the belt 103 is driven by a motor 106 mounted thereon. When the motor starts, the belt 103 turns in the direction of the arrow in FIG. 2. The belt speed should preferably be substantially the same as the web speed.

Figure 2:
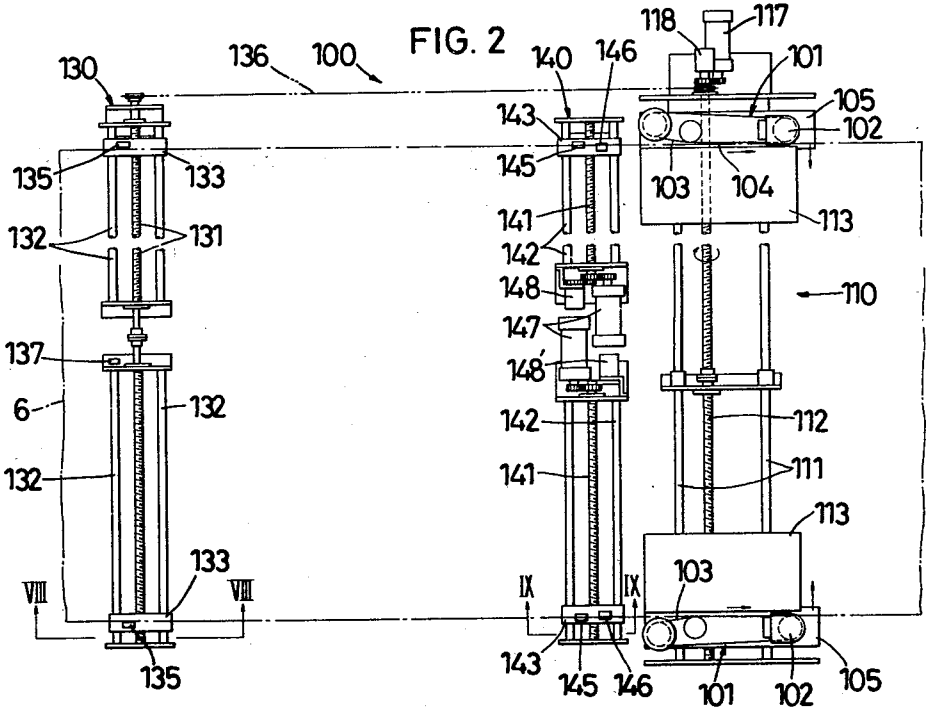
FIG. 2 is a plan view of a web guide system according to the present invention.
Figure 4:
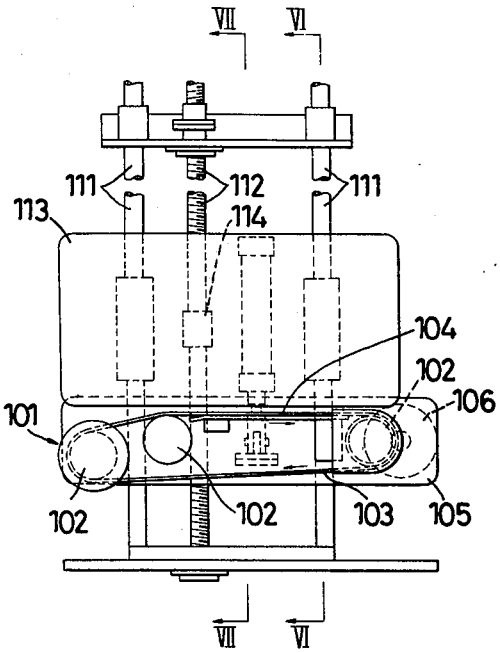
FIG. 4 is a plan view of a portion of the web guide
Figure 5:
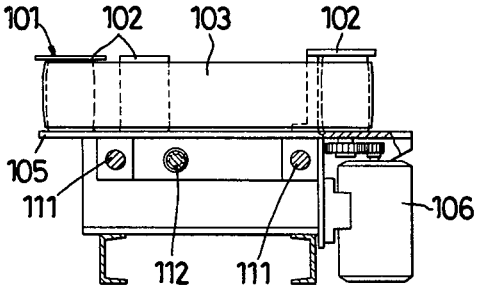
FIG. 5 is a side view of the same.
Figure 6:
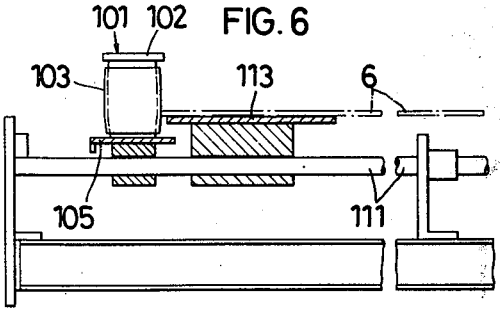
FIG. 6 is a vertical sectional view taken along the line VI—VI in FIG. 4.
Figure 7:
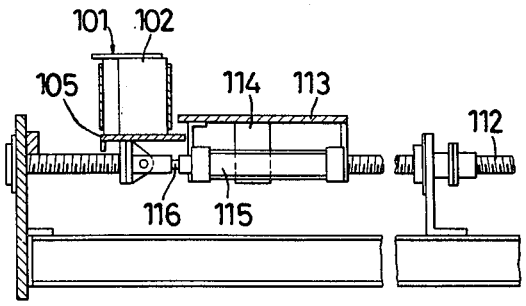
FIG. 7 is a vertical sectional view taken along the line VII—VII in FIG. 4.

The guide moving unit 110 comprises a pair of guide bars 111 and a threaded rod 112 having two portions threaded in opposite directions (FIG. 2). The guide bars 111 and the rod 112 are parallel to each other and perpendicular to the web running direction. A web supporting plate 113 is secured to a nut 114 threadedly mounted on the rod 112 (FIG. 7) so as to be movable along the rod. The web supporting plate 113 carries a cylinder 115 thereunder and a piston rod 116 of the cylinder is coupled to the guide supporting plate 105 which is movable along the guide bars 111 (FIG. 7). The two web guides are driven by a single motor and are adapted to move in opposite directions an equal distance from the reference line which is the center line of the corrugating machine in the preferred embodiment.

The rod 112 is driven by a reversible motor 117 arranged at one side of the mechanism (FIG. 2). When the rod is rotated in the direction of the arrow in FIG. 2, the supporting plates 105 and 113 and thus the web guides 101 move inwardly (as shown by the arrows), and vice versa. When the piston rod 116 (FIG. 7) is advanced, the guide supporting plate 105 is moved outwardly, independently of the movement of the rod 112.

The position of the web guide 101 is detected by an encoder 118 which transforms the revolutions of the rod 112 to pulses.

Figure 3:
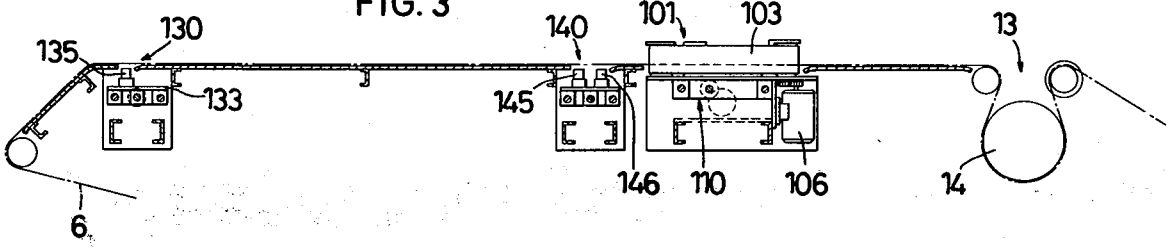
FIG. 3 is a side view of the same.

The sensor means for actuating the guide moving unit 110 includes a first sensing unit 130 movable transversely for detecting the approach of a wider web and a second sensing unit 140 movable transversely for following the edge of the running web (FIGS. 2 and 3). The signal from the first sensing unit 130 actuates the cylinder 115 and the signal from the second sensing unit 140 actuates the reversible motor 117 for the rod 112.

Figure 8:
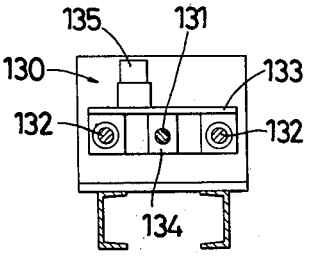
FIG. 8 is a vertical sectional view taken along the line VIII—VIII in FIG. 2.
Figure 9:
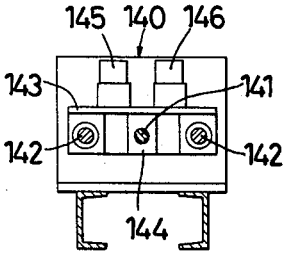
FIG. 9 is a vertical sectional view taken along the line IX—IX in FIG. 2.

The first sensing unit 130 includes a threaded rod 131 having two portions threaded in opposite directions, a pair of guide bars 132 on opposite sides of the rod 131, and a photocell supporting plate 133. The rod 131 and the guide bars are parallel to each other and perpendicular to the web running direction. The supporting plate 133 is secured to a nut 134 threadedly mounted on the rod 131 (FIG. 8) so as to be movable transversely guided by the guide bars 132. A photocell 135 is mounted on each supporting plate 133.

The rod 131 is coupled to the rod 112 for the guide moving unit 110 by means of a chain 136 on sprockets (FIG. 2). Thus, the rotation of the reversible motor 117 is transmitted to the rod 131, which moves the photocell supporting plates 133 transversely.

Each of the photocells 135 is normally disposed at such a position outside the straight guide portion 104 of the endless belt 103 that it will not operate in response to any relatively small displacement of the fibreboard web 6 in a transverse direction. If a wider web than the old web comes as a result of a lot change, the light of the photocell 135 is interrupted by the web so that the photocell produces a detection signal. The detection signal actuates the cylinder 115 instantly so that before the new wider web 6 reaches the web guides 101, the piston rod 116 will advance to move the web guide 101 to such a position that the straight guide portion 104 of the endless belt 103 will not be hit by the edge of the new wide web 6.

The first sensing unit 130 also has a photocell 137 (FIG. 2) fixed in the center thereof for detecting the presence of fibreboard web 6.

The second sensing unit 140 includes two threaded rods 141 turning in opposite directions, and each having a pair of guide bars 142 on opposite sides thereof and a supporting plate 143 movable along the guide bars. Each supporting plate 143 is secured to a nut 144 threadedly mounted on the corresponding rod 141. A pair of photocells 145, 146 are mounted on each supporting plate 143. Each rod 141 is driven by a respective reversible motor 147 to move the corresponding supporting plate 143 transversely.

The pair of photocells 145 and 146 are spaced at a small distance of about 3–5 mm, one being positioned more inwardly than the other. A motor 147 for each rod 141 is controlled according to whether or not the light of these photocells is interrupted by the web. If only the light of the inner photocell is interrupted, that is, the edge of the running web is located between the two photocells 146, the motor 147 is not actuated. If the light of neither of the photocells 145 and 146 is interrupted, the motors 147 will drive the rods 141 in a normal direction to move the photocell supporting plates 143 inwardly. If the light of both of the photocells is interrupted, the motors 147 will drive the rods 141 in a reverse direction to move the suporting plates outwardly.

The number of revolutions of each rod 141 is transformed to pulses by a corresponding encoder 148, 148' to detect the position of the photocells 145 and 146. The signal from these encoders 148 and the signal from the encoder 118 for detecting the position of the web guide 101 are used to control the position of the web guide according to the width of the web 6 in a manner as described below.

Figure 10:
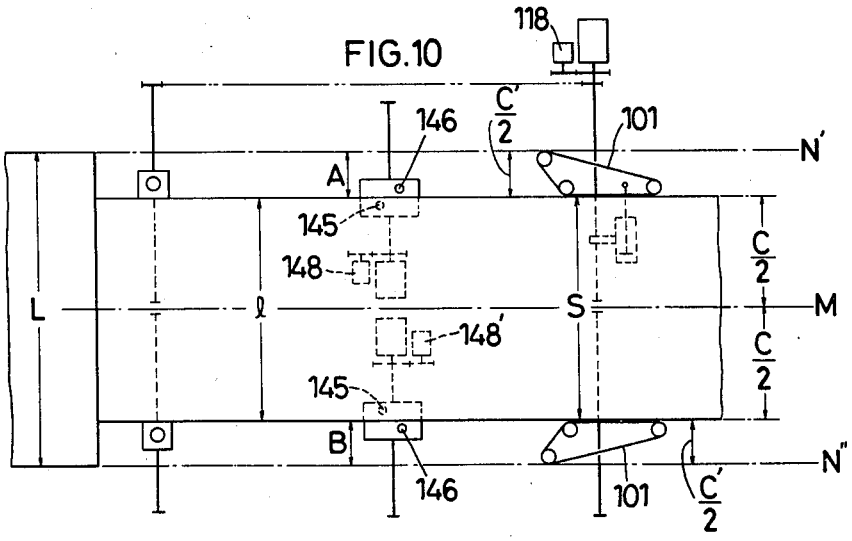
FIG. 10 is a schematic plan view of the web guide system showing the concept of control.

The manner of control will be described below with reference to FIGS. 10–12.

Assuming that a value corresponding to the maximum web width is L and that lines extending at a distance of L/2 from the center line M of the corrugating machine are base lines N' and N'' and that the signals from the encoders 148 and 148' when the photocells 145 and 146 have moved inwardly from these base lines N', N'' are A and B, respectively, a value l corresponding to the width of the running web to be guided is $$l=L-A-B$$

Next, assuming that when a pair of the web guides 101 have moved outwardly from the center line M to appropriate positions according to the width of the web, the signal from the encoder 118 is C, a value S corresponding to the distance between the straight guide portions 104 of the belts 103 is equal to C.

$$S=C$$

From these two equations, $$l:(L-A-B)=S:C$$

Thus, $$l = S$$

Theoretically, a pair of the web guides 101 may be controlled so that l will be equal to S (l=S). However, such a precise control is not necessarily needed and not practical because the web guides would hunt. Practically, it is sufficient to control the pair of the web guides with some amount of allowance or tolerance.

Figure 11:
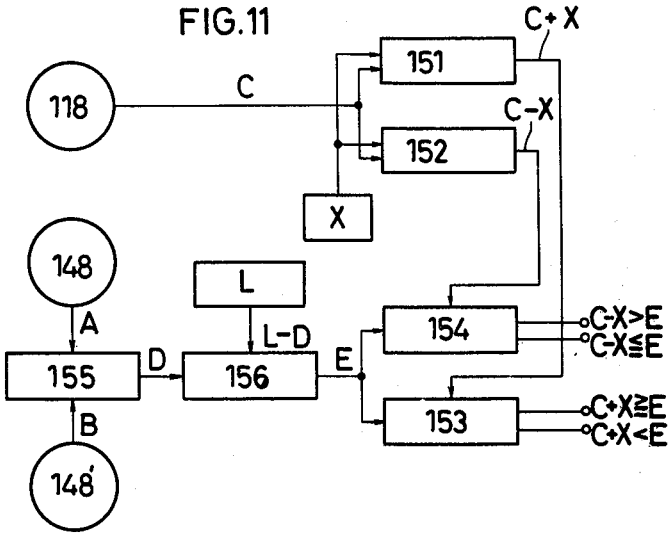
FIG. 11 is a block diagram of a control circuit employed in this invention.

Referring to FIG. 11, the signal C from the encoder 118 and a value X for giving some tolerance are inputted to an adder 151 and a subtractor 152 where the computation (C+X) and C−X) is performed, respectively.

On the other hand, the signals A and B from the encoders 148 and 148', respectively, which increase as the photocells 145 and 146 move inwardly from the base lines N', N", are inputted to an adder 155 to add A to B. The output signal D from the adder 155 and the value L corresponding to the maximum web width are supplied to a subtractor 156 which performs the subtraction (L−D). The output E from the subtractor 156 is compared with the output from the adder 151 at a first comparator 153 and with the output from the subtractor 152 at a second comparator 154.

If $C-X \leqq E \leqq C+X$, the signals from the comparators 153 and 154 will not actuate the reversible motor 117. If $E<C-X$, the motor 117 will drive the rod 112 in a normal direction to move the web guides 101 inwardly. If $E>C+X$, the motor will drive the rod 112 in a reverse direction to move the web guides outwardly. This assures that the web guides 101 are moved according to the width of the running web and to an equal distance from the center line of the machine.

In the above-described control method, the lines N' and N" corresponding to the maximum web width are used as the base lines, but this is only an example. Any other lines can be used. They are selected merely to obtain the value l corresponding to the width of the running web.

In the above described first embodiment, a pair of the web guides are controlled so that the distance between the web guides as measured with the center line M of the corrugating machine as the base will be substantially equal to the width of the running web as determined from the distance which the photocells 145 and 146 have moved inwardly from the base line N' and N" for the maximum web width. But, alternatively, they may be controlled so that the distance between the web guides as measured with the center line M of the corrugating machine as the base will be substantially equal to the width of the running web as determined from the distance which the photocells 145 and 146 have moved outwardly from the center line M of the corrugating machine while following each edge of the running web.

Further alternatively, they may be controlled so that the distance between the web guides as measured from the distance which the web guides 101 have moved inwardly from the base lines N' and N" will be substantially equal to the width of the running web as determined from the distance which the photocells 145 and 146 have moved inwardly from the base line N' and N".

Such a control method will be described below.

Similarly in the above-described mode of control, a value l corresponding to the width of web can be expressed as follows:

$$l = L - A - B$$

On the other hand, a value S corresponding to the distance between the straight guide portions 104 of the web guides 101 can be expressed by $$S = L - C'$$

wherein C' is the signal from the encoder 118 when the pair of web guides 101 have moved inwardly from the base lines N' and N" from the maximum web width instead of outwardly from the center line M.

From these two equations, $$l = (L - A - B) = S = (L - C')$$

Thus, $$A + B = C'$$

In this mode of control, too, although theoretically the pair of the web guides 101 may be controlled so that A+B will be equal to C', such a precise control is not necessarily needed and not practical because the web guides would hunt. Therefore, the web guides are controlled with some amount of tolerance.

Figure 12:
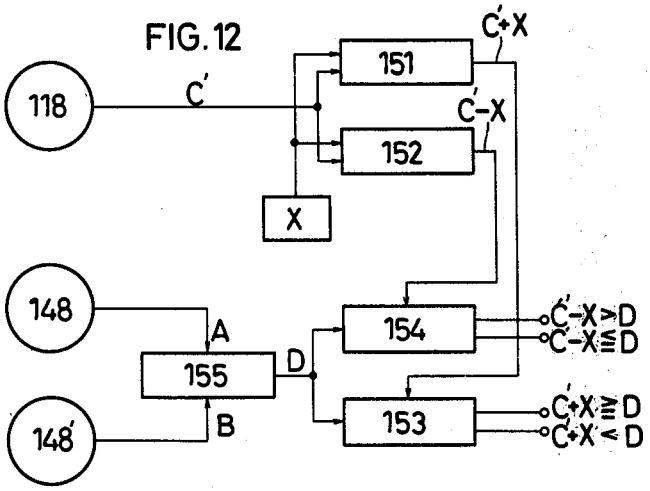
FIG. 12 is a block diagram of another example of a control circuit.

FIG. 12 is a block diagram for such a mode of control. The value C' from the encoder 118 and a value X for giving some tolerance are inputted to an adder 151 and a subtractor 152 where the computation (C'+X) and (C'−X) is performed, respectively.

On the other hand, the signals A and B from the encoders 148 and 148', which increase as the photocells 145 and 146 move inwardly from the base lines N' and N", are inputted to an adder 155 where they are added together. The output D from the adder 155 is compared with the output, C'+X, from the adder 151 at the first comparator 153 and with the output, C'−X, from the subtractor 152 at the second comparator 154.

If $(C'-X) \leqq D \leqq (C'+X)$, the signals from the comparators 153 and 154 will not actuate the reversible motor 117. If $D<C'-X$, the motor 117 will drive the rod 112 in a normal direction to move the web guides 101 inwardly. If $D>C'+X$, the motor will drive the rod 112 in a reverse direction to move the web guides outwardly.

In this mode of control, too, the lines N' and N" corresponding to the maximum web width are used as the base lines, but this is a mere example.

The operation of the web guide system according to this invention will be described below.

Let us suppose that the running web 6 is being guided by a pair of the web guides 101 disposed at each side thereof. If the web changes from a narrow one to a wider one as a result of a lot change, the new wider web will interrupt the light of the photocells 135 in the first sensing unit 130. In response to the signal from the photocells 135 the cylinders 115 will operate instantaneously so that the piston rods 116 advance to move the supporting plates 105 for the web guides 101 outwardly to get the web guides well out of way. Otherwise, the new wide web would be damaged by hitting the web guides. The first sensing unit 130 is provided at a distance upstream of the web guides 101 to give time for such an outward movement of the web guides.

When the new wide web 6 reaches the second sensing unit 140, it interrupts the light of the photocells 145 and 146. Instantaneously, two reversible motors 147 in the second sensing unit 140 and the reversible motor 117 in the guide moving unit 110 will start. As a result, the rods 141 will turn at a high speed to move the photocell supporting plates 143 outwardly, and the rod 112 will turn to move the web supporting plates 113 and thus the guide supporting plates 105 outwardly.

When the photocells 145 and 146 come to a position where one edge of the web is located between them, the corresponding motor 147 will stop. When the web supporting plates 113 and thus the guide supporting plates 105 have come to a correct position as a result of computation based on the signals from the encoders 118 and 148, the reversible motor 117 will stop and simultaneously the cylinders 115 operate to retract the piston rods 116 so that the guide supporting plates 105 will return to their normal position where the straight guide portion 104 of each endless belt 103 guides the respective edge of the running web.

If the web has changed from a wide one to a narrower one as a result of a lot change, the light of neither of the photocells 145 and 146 will be interrupted by the new web because it is narrower than the old one. In response to the signal from the photocells, the reversible motors 147 will start to turn the rods 141 in such a direction as to move the photocell supporting plates 143 inwardly. Simultaneously, the motor 117 in the guide moving unit 110 will start to turn the rod 112 in a normal direction so that the guide supporting plates 105 will move inwardly until the straight guide portions 104 of the endless belts 103 come to their position for guiding.

In the above-described embodiment, it should be noted that even if the web runs out of true upstream of change so long as there is no change in the web width. If the values A and B are not equal to each other in FIGS. 11 and 12, the web guides may not be moved.

Figure 13:
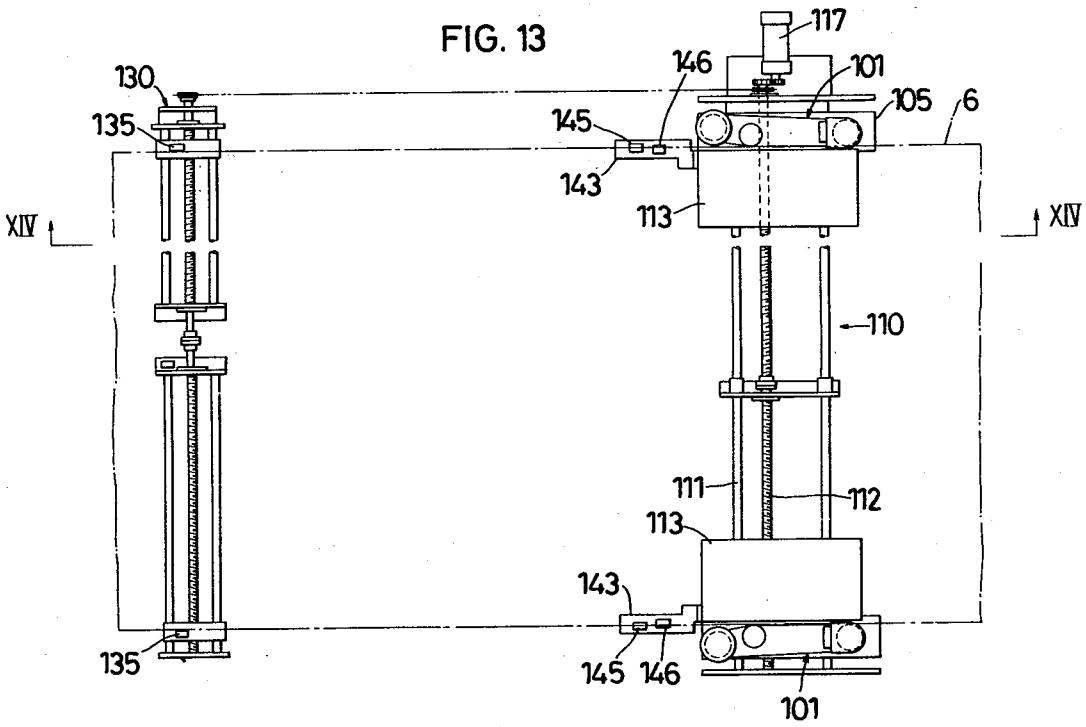
FIG. 13 is a plan view of another embodiment of the web guide system according to this invention.
Figure 14:
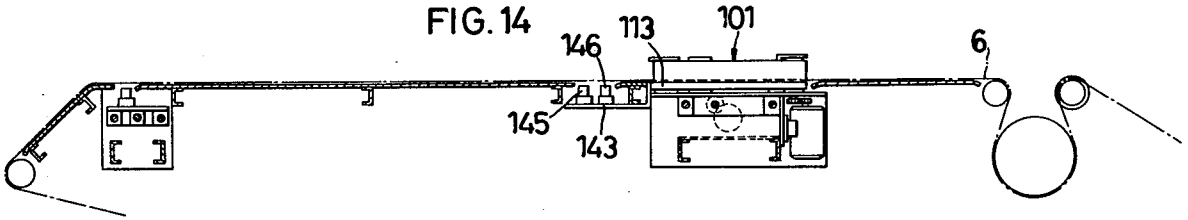
FIG. 14 is a vertical sectional view taken along the line XIV—XIV in FIG. 13.

Referring to FIGS. 13 and 14 showing another embodiment of the web guide system according to the present invention, a photocell supporting plate 143 is secured to the front side of each web supporting plate 113. On the plate 143 are mounted a pair of photocells 145 and 146 for detecting the edge of the running web. The manner of arrangement of the photocells is the same as described above in the first embodiment. The manner of control of the reversible motor 117 is similar to that in the first embodiment, but, since no encoder is involved in the second embodiment, it is slightly different therefrom. The reversible motor is operated until both edges of the running web come between a pair of the photocells at each side, that is, to a position where the light of one photocell is interrupted by the web and the light of the other is not interrupted.

The photocells 135 operate in the same manner as in the first embodiment for emergency increase of the distance between the web guides upon the detection of arrival of a wider web.

In the second embodiment, by controlling the reversible motor 117 by the signals from the photocells 145 and 146, the web guides 101 can be moved to appropriate positions according to the width of the running web. No control circuit such as shown in FIGS. 11 and 12 is needed. Also, the motors 147, encoders 118 and 148, rods 141, guide bars 142 used in the first embodiment can be eliminated. This means that the second embodiment is much simpler in structure than the first embodiment.

In producing double wall corrugated fibreboard, two single faced fibreboards to be glued together may be guided by two web guide systems in the same manner with the center of the corrugating machine as the reference line.

One or both of these two web guide systems may also be conveniently adapted to be movable in a direction at a right angle to the web running direction so that one or both of the single faced fibreboards can be moved transversely to adjust the alignment of two systems with each other.

Both in the first embodiment and the second embodiment, the web guides are moved to appropriate positions for the width of the running web, if there is any change in the web width. The positions are always at an equal distance from the reference line which is often the machine center.

Although in the preferred embodiments threaded rods driven by motors are used to move the web guides 101 and the photocells, a sprocket-chain arrangement or a cylinder may be used instead as means for moving them. Instead of an encoders, linear potentiometer or any other similar means may be used to detect the position of the web guides and the photocells.

Although in the present invention the first sensing unit 130 is used to detect the arrival of a wider web, it is not an essential element because the web guides can be moved outwardly by manual operation each time the material is changed from a narrow web to a wider web.

Although in th preferred embodiment the web guides are controlled with the center of the corrugating machine as the reference, any other suitable point may be used as the reference point for control.

Although a web guide of the preferred embodiment has a straight portion of the endless belt for engaging and guiding the web, it may be adapted to engage the web edge at one point thereof rather than in a line-to-line manner.

Although in the preferred embodiments photocells are used as sensors, they may be replaced with proximity switches or pneumatic sensors. Although a pair of photocells are used for each edge of the web in the second sensing unit in the preferred embodiments, a single photocell having a dead band sandwitched between two sensitive ranges may be used for each edge of the web. Particularly if pneumatic sensors are used, a single one will suffice for each edge of the web.

As the web guide means, a flat guide plate or rollers may be used instead of an endless belt passing around rolls.

It will be understood from the foregoing that in the present invention the edges or width of the running web are detected and the web guides are moved automatically and instantaneously in a transverse direction to their appropriate positions for the width of the running web detected. This improves the working efficiency and minimizes the rate of defective products.

Since the web guides are quickly moved outwardly in response to the signal from the first sensing unit, there is no possibility that the web will be damaged or broken at its edge by the web guides even if a much wider web arrives as a result of an order change.

Since the web guide used includes a plurality of rolls and an endless belt running around the rolls at substantially the same speed as the web speed, and the inner portion of the endless belt there of being adapted to engage the edge of the web, the level of noise produced and the possibility of web breakage are much less than in the conventional web guide system.

Although the present invention has been described with reference to the preferred embodiments, it should be understood that many changes or variations can be made within the scope of the present invention.

What we claim:

1. A web guide systm for guiding a corrugated fibreboard web on a corrugating machine to prevent it from running out of true, said system comprising:

a pair of web guides movably mounted at the sides of said corrugating machine for movement transversely of the path of the web through said machine for guiding the edges of the running web, a sensing means disposed upstream of said web guides and having at least one pair of sensors movable transversely for detecting and following the edges of the running web, and a guide moving means responsive to the signal from said sensing means for moving said web guides transversely so that the distance between said web guides will be substantially equal to the width of the running web.

2. A web guide system as claimed in claim 1, in which said sensors are movably mounted for movement transversely of the path of the web, and said web guide system further comprising means responsive to the signal from said sensing means and connected to said sensors for moving said sensors in the sensing means transversely, a first transformer means for transforming into an electrical signal the distance which said web guides have been moved by said guide moving means, and a control circuit connected to said guide moving means and adapted to receive the signals from said first and second transformer means to control said guide moving means for moving said web guides to positions according to the web width.

3. A web guide system as claimed in claim 1 or 2 wherein each of said web guides comprises an endless belt, a plurality of rolls around which said endless belt passes in a path parallel to the path of movement of the web, a motor for driving said endless belt, and a supporting plate on which said rolls, endless belt and motor are mounted, an inner portion of said endless belt serving to guide the edge of the running web so the web does not run out of true.

4. A web guide system as claimed in claim 1 wherein said guide moving means comprise a reversible motor and a threaded rod coupled to said web guides and driven by said reversible motor.

5. A web guide system as claimed in claim 2 wherein said means for moving said sensors in the sensing means comprise a pair of reversible motors, a pair of threaded rods each driven by a corresponding one of said reversible motors and coupled to a plate carrying said sensors in said sensing means.

6. A web guide system as claimed in claim 2 wherein said first and second transformer means each comprise at least one encoder connected to said control circuit.

7. A web guide system as claimed in claim 1, further comprising a further sensing means disposed upstream of said sensing means and having a pair of sensors movable transversely of the path of the web for detecting the approach of a wider web and a further guide moving means connected to said web guides and responsive to the signal from said further sensing means for moving said web guides into and out of their operative position.

8. A web guide system as claimed in claim 7 wherein said further sensing means comprise means for moving said sensors therein transversely, said moving means being coupled to said guide moving means.

9. A web guide system as claimed in claim 7 wherein said further guide moving means comprise a pair of cylinders each having a piston rod coupled to the corresponding web guide.

10. A method for guiding a corrugated fibreboard web on a corrugating machine while the web is running, comprising detecting the edges of said running web by a pair of sensors, and controlling a pair of web guides according to the output from said sensors so that the distance between said web guides will be substantially equal to the width of said running web, detecting the approach of a wider web than that at said web guides at a point upstream of said web guides, and moving said web guides outwardly out of way of said wider web in response to the detection of said approach and then further moving said web guides to appropriate positions for the wider width of the running web.

* * * * *